US012571281B1

(12) United States Patent
Zhong

(10) Patent No.: US 12,571,281 B1
(45) Date of Patent: Mar. 10, 2026

(54) GARTER SPRING ASSEMBLY FOR SEALING DEVICES IN WELL SYSTEMS

(71) Applicant: Halliburton Energy Services, Inc., Houston, TX (US)

(72) Inventor: Xiaoguang Allan Zhong, Sinpapore (SG)

(73) Assignee: Halluburton Energy Services, Inc., Houston, TX (US)

( * ) Notice: Subject to any disclaimer, the term of this patent is extended or adjusted under 35 U.S.C. 154(b) by 0 days.

(21) Appl. No.: 19/005,428

(22) Filed: Dec. 30, 2024

(51) Int. Cl.
*E21B 33/12* (2006.01)

(52) U.S. Cl.
CPC ..... *E21B 33/1216* (2013.01)

(58) Field of Classification Search
CPC ..... E21B 33/1208; E21B 33/1216
See application file for complete search history.

(56) References Cited

U.S. PATENT DOCUMENTS 4,509,763 A * 4/1985 Fischer ..... E21B 33/1208 277/342
4,750,559 A 6/1988 Greenlee et al.
4,809,989 A * 3/1989 Kernal ..... E21B 33/1208 277/584
4,907,788 A 3/1990 Balsells
5,203,849 A * 4/1993 Balsells ..... F16F 3/04 267/1.5
5,265,890 A * 11/1993 Balsells ..... F16J 15/3236 277/467
5,311,938 A 5/1994 Hendrickson et al.
5,928,676 A 7/1999 Notter
9,617,822 B2 4/2017 O'Conner et al.
10,247,311 B2 4/2019 Frederick
10,253,592 B2 4/2019 Ingram et al.
11,353,079 B2 * 6/2022 Whitford ..... F16F 3/06
2006/0290066 A1 * 12/2006 Hiorth ..... E21B 33/1208 277/322
2017/0350211 A1 * 12/2017 Ingram ..... E21B 33/134
2020/0399976 A1 * 12/2020 Sevadjian ..... E21B 33/128

(Continued)

FOREIGN PATENT DOCUMENTS

WO 2012112333 8/2012

OTHER PUBLICATIONS

"Garter Spring", Wikipedia; https://en.wikipedia.org/wiki/Garter_spring Last edited on Sep. 21, 2024, 3 pages.

(Continued)

*Primary Examiner* — David Carroll
(74) *Attorney, Agent, or Firm* — DeLizio, Peacock, Lewin & Guerra LLP

(57) ABSTRACT

Systems, methods, and apparatus for implementing a sealing device having a garter spring assembly in a well system. The sealing device may include a sealing element configured to establish a seal in a wellbore of the well system. The sealing device may also include a garter spring assembly coupled with the sealing element. The garter spring assembly may include one or more garter springs and a premade continuous insert positioned within a cavity formed by an inner diameter of the one or more garter springs and configured to fill the cavity. The garter spring assembly may include adjacent garter springs that are positioned to have opposite coil orientations.

17 Claims, 7 Drawing Sheets

(56) References Cited

U.S. PATENT DOCUMENTS

| | | | | |
|---|---|---|---|---|
| 2022/0298884 | A1* | 9/2022 | Glad | E21B 33/1216 |
| 2025/0155024 | A1* | 5/2025 | Schroeder | E21B 33/1216 |
| 2025/0207650 | A1* | 6/2025 | Toh | E21B 33/128 |

OTHER PUBLICATIONS

Stoev, et al., "Computer Modeling of In-Reactor Gamma-Ray Spectroscopy for Garter Spring Position Determination", 9th CNS International Conference on Candu Maintenance, Toronto, Ontario, Canada, Dec. 406, 2011, 14 pages.

"PCT Application No. PCT/US2025/012236 International Search Report and Written Opinion", Sep. 19, 2025, 12 pages.

* cited by examiner

GARTER SPRING ASSEMBLY FOR SEALING DEVICES IN WELL SYSTEMS

TECHNICAL FIELD

The present invention relates generally to oil and gas systems and services, and more specifically to a garter spring assembly for sealing devices in well systems.

BACKGROUND

The oil and gas services industry uses various types of well equipment and tools in well systems at well sites. Well systems may use garter springs as extrusion prevention mechanisms for sealing devices in a wellbore. The sealing devices may include packers, bridge plugs, and other types of well devices with sealing elements. Extrusion typically refers to the process where the sealing elements of the sealing device of the well system that are forming the seal in the wellbore may be forced out of place (e.g., under high pressure conditions), which may cause a loss of the seal and/or a failure of the sealing device. Garter springs may be used in sealing devices as a mechanical reinforcement to prevent extrusion. However, garter springs may have defects that may be partially attributed to the manufacturing process of the sealing devices with the garter springs. Some common issues with the garter springs include breaking up at the garter spring end connection, rubber protrusions through the garter spring, cracks or fractures in the rubber around the garter springs, or a combination of the aforementioned issues. For example, manufacturing induced inhomogeneity in the garter spring assembly or voids left in the garter spring assembly during manufacturing can result in fracture or crack initiation in the garter spring assembly. The number and placement of the defects in the garter spring assembly is typically stochastic or randomly differs from one garter spring assembly to another, which increases the uncertainty in predicting garter spring assembly defects. Cracks, fractures, or other defects in the garter spring assembly may result in a loss of seal in the sealing elements and form leak paths in the wellbore.

DESCRIPTION

The description that follows includes example systems, methods, techniques, and program flows that describe aspects of the disclosure. However, it is understood that this disclosure may be practiced without these specific details. For instance, this disclosure refers to certain well systems, devices, or tools in illustrative examples. Aspects of this disclosure can be instead applied to other types of well systems, devices, and tools. In other instances, well-known instruction instances, protocols, structures, and techniques have not been shown in detail to avoid confusion.

Figure 1:
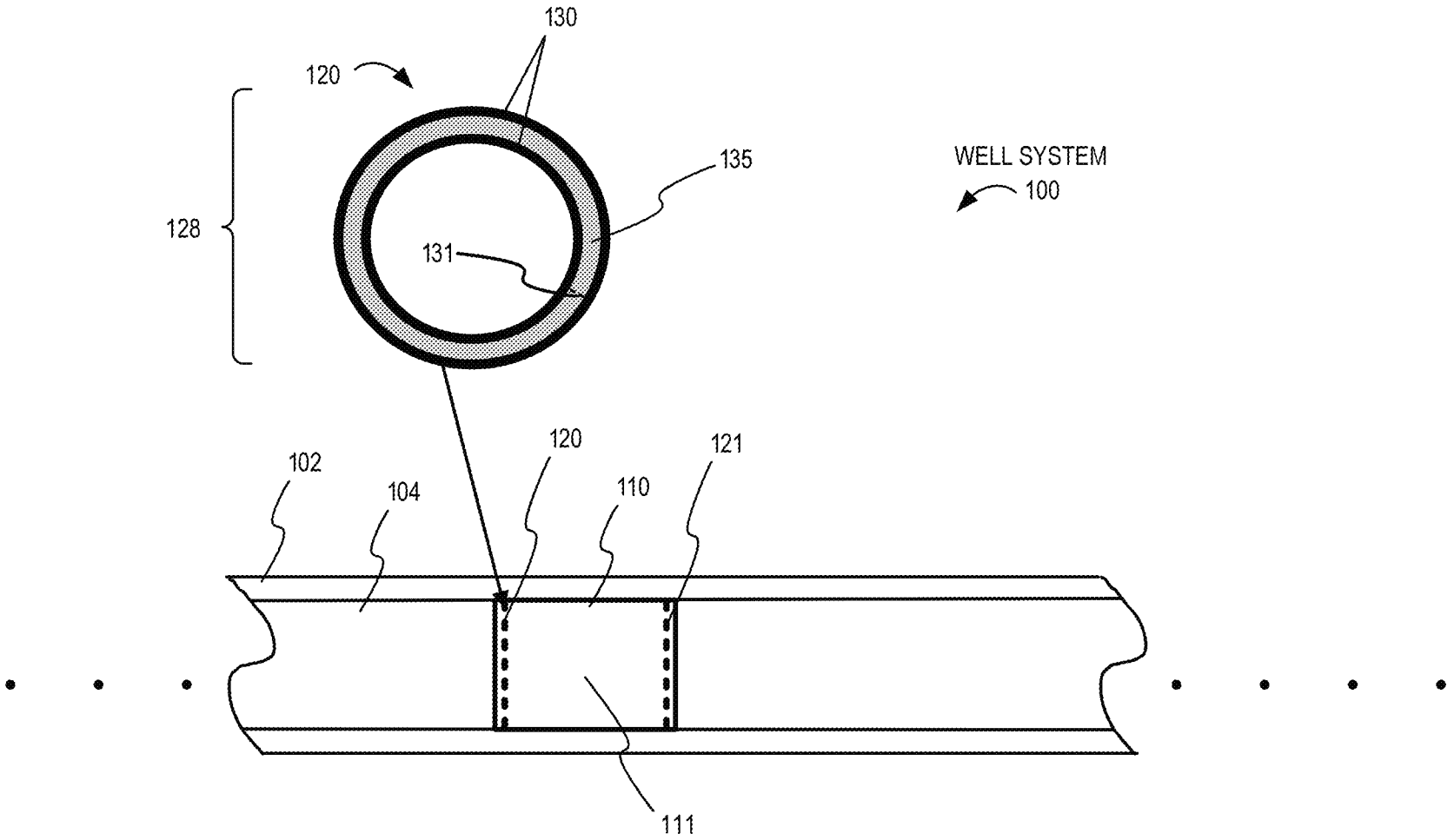
FIG. 1 depicts a schematic diagram of an example well system including one or more sealing devices having a garter spring assembly, according to some implementations.
Figure 7:
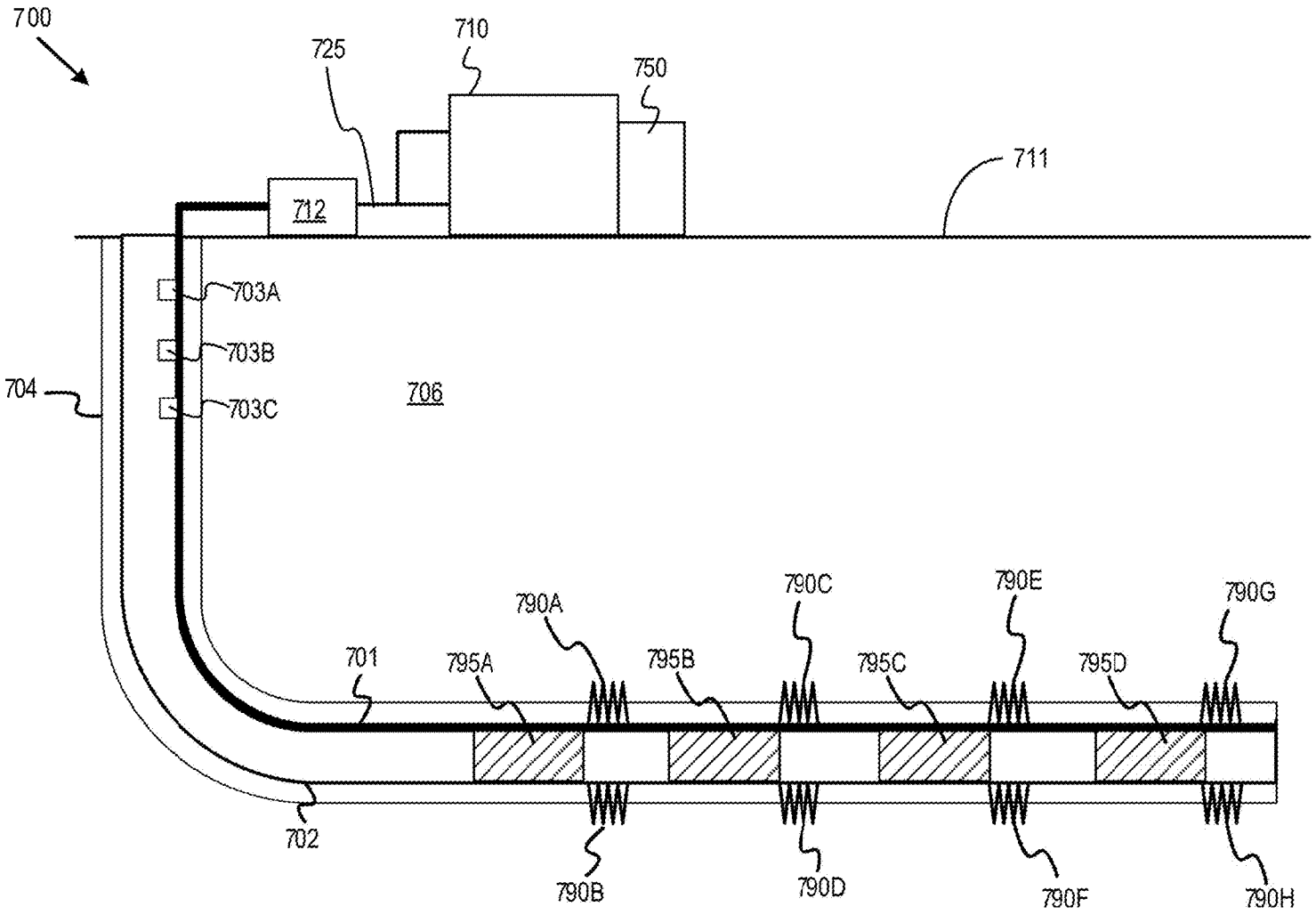
FIG. 7 is a schematic diagram of an example well system that includes fracturing operations, according to some implementations.

FIG. 1 depicts a schematic diagram of an example well system 100 including one or more sealing devices having a garter spring assembly, according to some implementations. In some implementations, the well system 100 may include a wellbore 102, a workstring 104 (or other type of well tubing), surface equipment and tools (not shown), and downhole equipment and tools, such as the sealing device 110. The sealing device 110 may be various types of sealing devices, such as a packer, a bridge plug, or any other type of downhole well tool having sealing elements. FIG. 1 shows a portion of the downhole horizontal section of the well system 100 for simplicity. It is noted that the well system 100 may include multiple sections (e.g., horizontal, vertical and/or lateral), multiple zones, and multiple sealing devices, as shown in FIG. 7. For example, each zone of the well system 100 may include one or more sealing devices (e.g., the sealing device 110). It is also noted that the well system 100 may include additional devices, tools and other components that are not shown for simplicity. The well system 100 may be any type of well system in the oil and gas industry, such as a drilling well system, a fracturing well system, a completion well system, and a producing well system.

In some implementations, the well system 100 may include a sealing device 110 (or multiple sealing devices) in each zone or section of the well system 100 to establish a seal in between zones or sections of the wellbore 102 to isolate each zone or section. In some implementations, the sealing device 110 may include a sealing element 111 that expands to establish a seal in the wellbore. For example, the sealing element 111 may be an expandable elastomer sealing element or an expandable rubber sealing element or any other type of sealing element or sealing mechanism that can establish a seal in the wellbore between the well tubing or piping (e.g., the workstring 104 or other type of tube or pipe string) and the casing of the wellbore 102. For example, the seal may be established in an annular area between an inner pipe or tube (e.g., the sealing device 110, such as a packer, of the workstring 104 or other type of tube or pipe string) and an outer tube or pipe (e.g., the casing of the wellbore 102). In some implementations, each sealing device 110 may include at least one garter spring assembly 120. In some implementations, each sealing device 110 may include a garter spring assembly at each end of the sealing device 110, such as the garter spring assembly 120 and a second garter spring assembly 121. In some implementations, the sealing element 111 and garter spring assemblies 120/121 form an integrated single part through a molding process. For example, during manufacturing, the garter spring assemblies (e.g., garter spring assemblies 120/121) may be molded to the sealing element 111 of the sealing device 110. For example, the garter spring assemblies may be molded in a position within the sealing element 111 of the sealing device 110 such that the garter spring assemblies can help strengthen the seal that is established by the sealing element 111 of the sealing device 110. Each garter spring assembly, such as the garter spring assembly 120, may include at least one garter spring 130 and an insert 135. As shown in the cross-sectional top view 128 of the grater spring assembly 120 in FIG. 1, the garter spring 130 has a circular ring shape (or an O-ring shape) having an inner diameter 131. In some implementations, the insert 135 may be a premade (or premanufactured) continuous insert that also has a circular ring shape and fills the cavity formed by the inner diameter 131 of the garter spring 130. In some implementations, the garter spring assembly may include two or more garter springs, and the insert 135 may be positioned to fill the cavity formed by the inner garter spring, as further described in FIG. 3. In some implementations, the insert 135 may be formed from one or more segments of the insert material that are joined together to form the circular ring-shaped insert, as further described in FIGS. 4A-5.

The premade continuous insert 135 can be positioned to fill the cavity formed by the inner diameter 131 of the garter spring 130 to eliminate potential voids or openings in the cavity during manufacturing. In some implementations, the insert 135 may be installed into the inner diameter 131 of the garter spring 130 by a shrink fit technique or procedure. For example, the insert 135 may be cooled to a relatively low temperature to shrink the insert 135, and then the insert 135 may be inserted or positioned into the cavity formed by the inner diameter 131 of the garter spring 130. When the insert 135 is returned to a normal or ambient temperature, the material of the insert 135 can expand, and interference between the insert 135 and the garter spring 130 arises. When the material of the insert 135 expands, the insert 135 can fill the cavity formed by the inner diameter 131 of the garter spring 130 completely and leaving no voids or gaps in the cavity. This can eliminate or minimize defects in the garter spring assembly that can cause a failure of the seal that is established by the sealing element 111 of the sealing device 110, which results in a more reliable and robust sealing device 110, increases operational efficiency and performance, and reduces operational cost. In some implementations, the insert 135 may have a diameter that is approximately the same or slightly larger than the inner diameter 131 of the garter spring 130. The shrink fit technique can allow the insert 135 to be placed in the cavity of the garter spring 130 even if the diameter of the insert 135 is larger than the inner diameter 131 of the garter spring 130.

In some implementations, the one or more garter spring inserts of the garter spring assembly 120, such as the garter spring insert 135, may be made or manufactured from a non-metallic or metallic material. For example, the garter spring insert 135 can be made or manufactured from a non-metallic material, such as a rubber material or a polymer material. Example polymer materials may include polyether ether ketone (PEEK) or polytetrafluoroethylene (PTFE), among others. As another example, the garter spring insert 135 can be made or manufactured from a metallic material, such as aluminum or brass. A metallic material may be used in low expansion applications. In other examples, other metallic materials may be used, such as steel.

Figure 2:
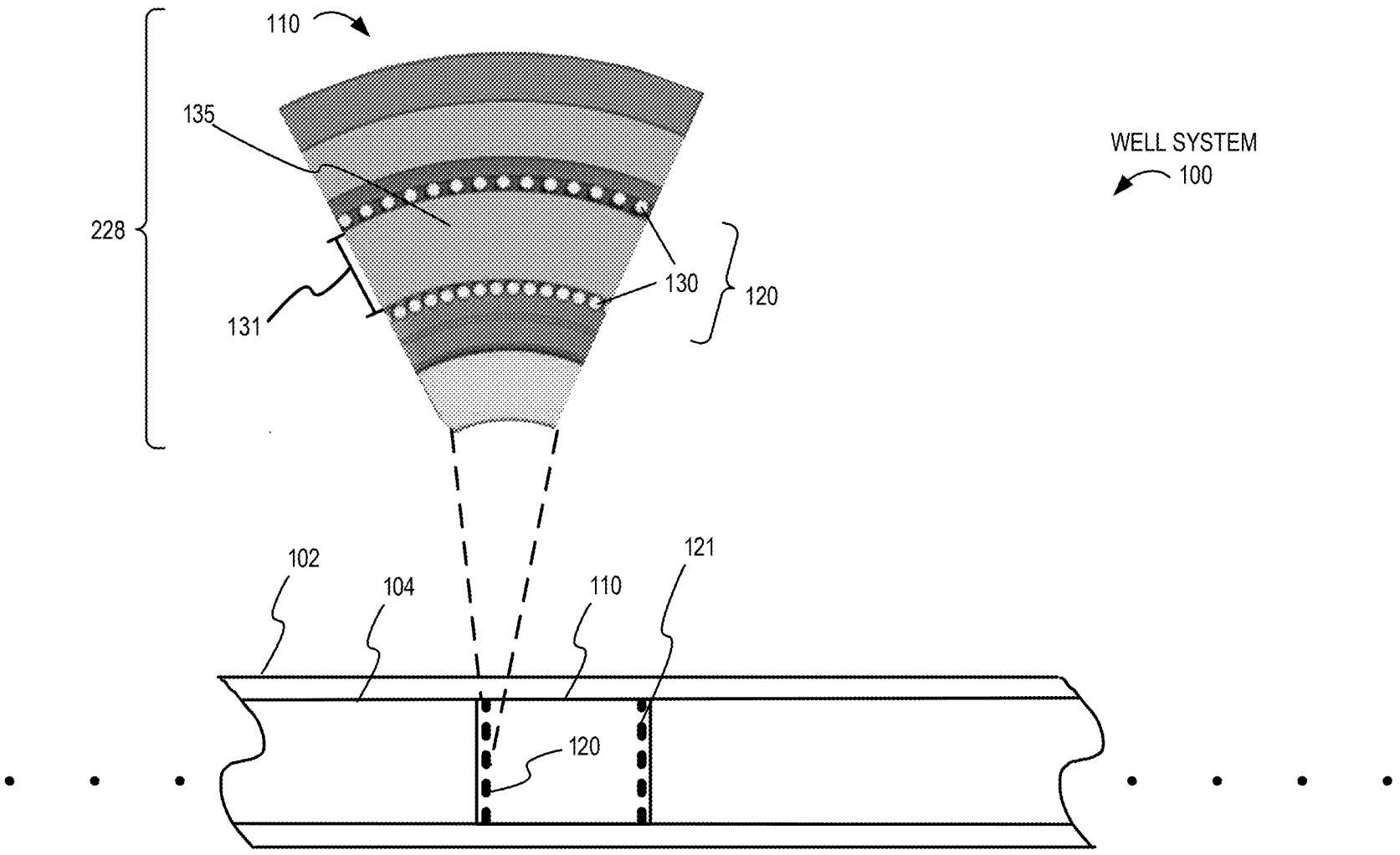
FIG. 2 depicts a schematic diagram of the example well system including a sealing element having a garter spring assembly with a single garter spring, according to some implementations.

FIG. 2 depicts a schematic diagram of the example well system 100 including a sealing element having a garter spring assembly with a single garter spring, according to some implementations. As described in FIG. 1, the well system 100 may include the wellbore 102, the workstring 104 (or other type of well tubing), and one or more sealing devices, such as the sealing device 110. In some implementations, the sealing device 110 may include at least one garter spring assembly 120. In some implementations, the sealing device 110 may include a garter spring assembly at each end of the sealing device 110, such as the garter spring assembly 120 and a second garter spring assembly 121. In some implementations, each garter spring assembly, such as the garter spring assembly 120, may include a single garter spring 130 and an insert 135. As shown in the cross-sectional view 228 of the sealing device 110 in FIG. 2, the sealing device 110 includes the garter spring assembly 120, and the garter spring assembly 120 includes the garter spring 130 (having an inner diameter 131) and the insert 135. In some implementations, the insert 135 may be a premade (or premanufactured) continuous insert that has a circular ring shape and fills the cavity formed by the inner diameter 131 of the garter spring 130. The cross-sectional view 228 shows a cross-section of the circular coils (or wire) of the garter spring 130, and the insert 135 inside the cavity formed by the inner diameter 131 of the coils of the garter spring 130.

In some implementations, the pitch of the garter spring 130 can be made or manufactured to be greater than the diameter of the coils (or wire) of the garter spring 130. The cross-sectional view 228 shows the cross-section of the coils or wires of the garter spring 130 that are circular in shape and look like multiple circles positioned in two rows. The pitch of the garter spring 130 is the distance between the center of two adjacent circles shown in the cross-sectional view 228. The diameter of the coils (or wire) is the diameter of each of the circles shown in the cross-sectional view 228. When the garter spring pitch is small, such as when the garter spring pitch is equal to the diameter of the coils of the garter spring, the self-contact of the coils or wire can become a strain concentration point. The rubber of the garter spring assembly 120 can fracture at the contact areas, becoming the nucleation point (or starting point) for crack or fracture growth into the rest of the garter spring assembly 120. In some implementations, the pitch of the garter spring 130 can be made or manufactured to be greater than or equal to 1.1 times (1.1×) the coil or wire diameter of the garter spring 130, so that there is sufficient gap in between the coil or wire spirals to prevent contact points. This can delay or eliminate crack initiation during setting of the seal of the sealing device 110. In one example, the pitch of the garter spring 130 can be made to be 1.5 times (1.5×) the coil or wire diameter of the garter spring 130. In another example, the pitch of the garter spring 130 can be made to be 2 times (2×) the coil or wire diameter of the garter spring 130. It is noted, however, that the pitch cannot be too large, otherwise the rubber can extrude through the garter spring 130.

Figure 3:
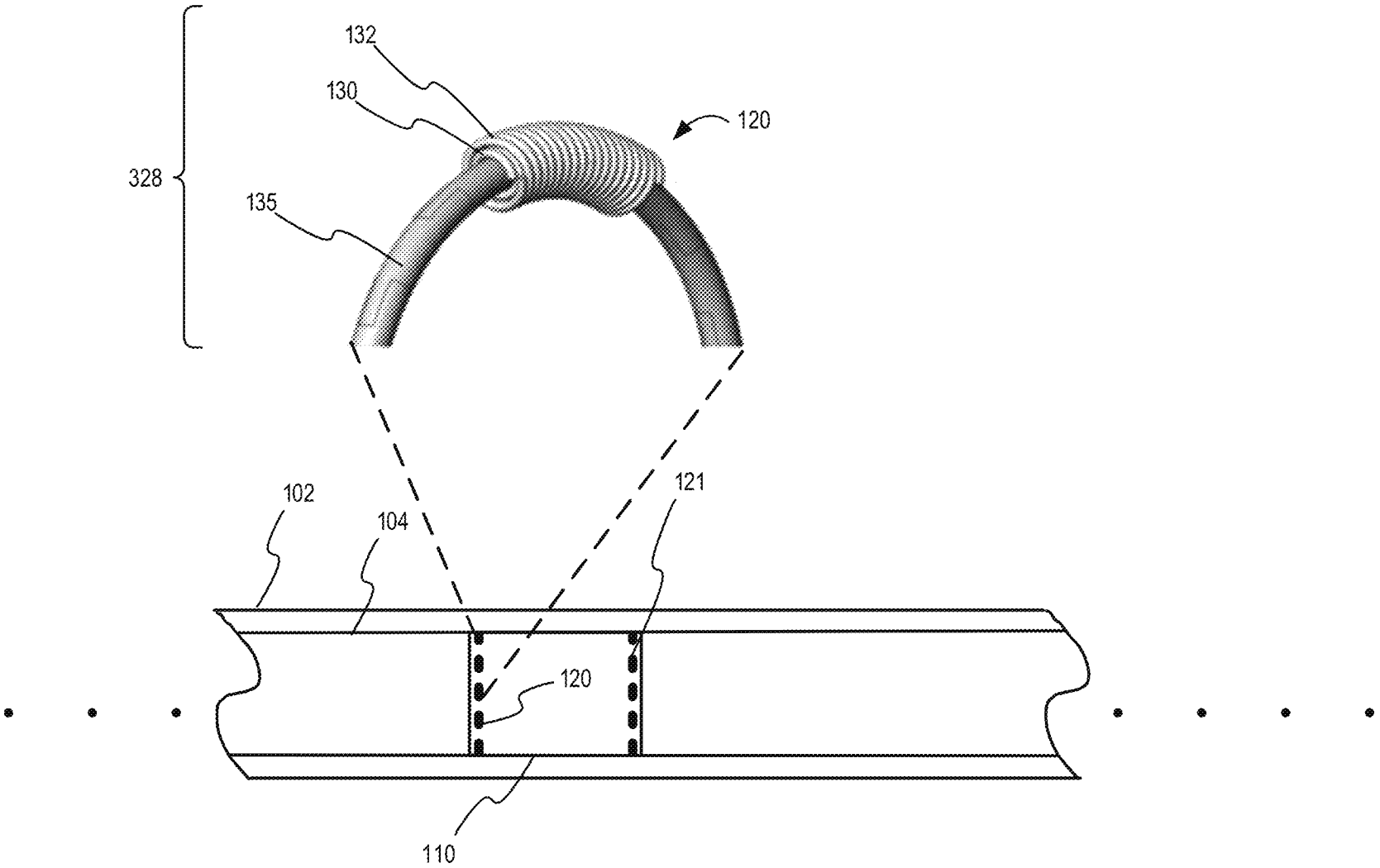
FIG. 3 depicts a schematic diagram of the example well system including a sealing element having a garter spring assembly with two garter springs, according to some implementations.

FIG. 3 depicts a schematic diagram of the example well system 100 including a sealing element having a garter spring assembly with two garter springs, according to some implementations. As described in FIG. 1, the well system 100 may include the wellbore 102, the workstring 104 (or other type of well tubing), and one or more sealing devices, such as the sealing device 110. In some implementations, the sealing device 110 may include at least one garter spring assembly 120. In some implementations, the sealing device 110 may include a garter spring assembly at each end of the sealing device 110, such as the garter spring assembly 120 and a second garter spring assembly 121. In some implementations, each garter spring assembly, such as the garter spring assembly 120, may include two garter springs, such as the garter spring 130 and a garter spring 132, and an insert 135. It is noted, however, that in other implementations each garter spring assembly may include three or more garter springs. As shown in the detailed view 328 of the garter spring assembly 120 in FIG. 3, one of the garter springs, such as the garter spring 130, may be the inner garter spring, and the other garter spring, such as the garter spring 132, may be the outer garter spring. In some implementations, the insert 135 may be a premade (or premanufactured) continuous insert that has a circular ring shape and fills the cavity formed by the inner diameter of the inner garter spring, such as the garter spring 130.

In some implementations, the two or more grater springs of the garter spring assembly 120 may be positioned such that adjacent garter springs have opposite coil orientations. In some implementations, the garter spring 130 (the inner garter spring) and the garter spring 132 (the outer garter spring) shown in FIG. 3 have opposite orientations. For example, the garter spring 130 may have a left-handed orientation and the garter spring 131 may have a right-handed orientation, or the garter spring 130 may have a right-handed orientation and the garter spring 131 may have a left-handed orientation. The adjacent garter springs with opposite orientation may improve the garter spring's resistance to tilting, as well as increase the garter spring's radial stiffness.

As described in FIG. 2, in some implementations, the pitch of the garter springs 130 and 132 can be made or manufactured to be greater than the diameter of the coils (or wire) of the garter springs 130 and 132. In some implementations, the pitch of the garter springs 130 and 132 can be made or manufactured to be greater than or equal to 1.1 times (1.1×) the coil or wire diameter of the garter springs 130 and 132, so that there is sufficient gap in between the coil or wire spirals to prevent contact points. This can delay or eliminate crack initiation during setting of the seal of the sealing device 110. In one example, the pitch of the garter springs 130 and 132 can be made to be 1.5 times (1.5×) the coil or wire diameter of the garter springs 130 and 132. In another example, the pitch of the garter springs 130 and 132 can be made to be 2 times (2×) the coil or wire diameter of the garter springs 130 and 132. It is noted, however, that the pitch cannot be too large, otherwise the rubber can extrude through the garter springs.

In some implementations, depending on the application, such as different expansion ratios and/or different performance requirements, the design and manufacture of the garter spring assembly 120 may utilize the premade continuous insert 135, and optionally one or more of the additional features, such as having two or more garter springs, having adjacent springs that have opposite coil orientation, and having a garter spring pitch that is greater than the diameter of the coils of the garter spring. In one non-limiting example, a double garter spring construction may be used and the garter springs may have a pitch of 2 times (2×) the coil diameter, respectively. In the double garter spring construction, the outer garter spring may have a right-handed orientation, and the inner garter spring may have a left-handed orientation (or vice versa). The premade continuous insert may have a diameter that is slightly larger than the inner diameter of the inner garter spring, and the insert is shrink-fit into the garter spring during manufacturing. In another non-limiting example, a single garter spring construction may be used including the premade continuous insert, and the garter spring may have a pitch of 1.5× the coil diameter.

Figure 4A:
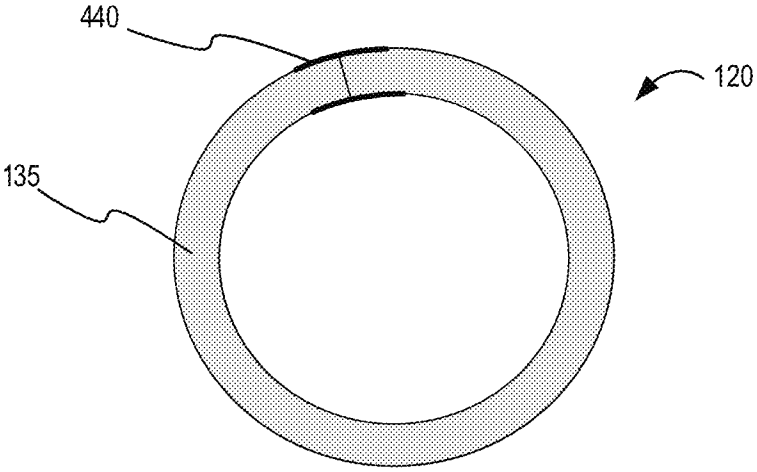
FIGS. 4A-4D depict schematic diagrams of example garter spring assemblies that include an insert having one or more segments, according to some implementations.
Figure 4B:
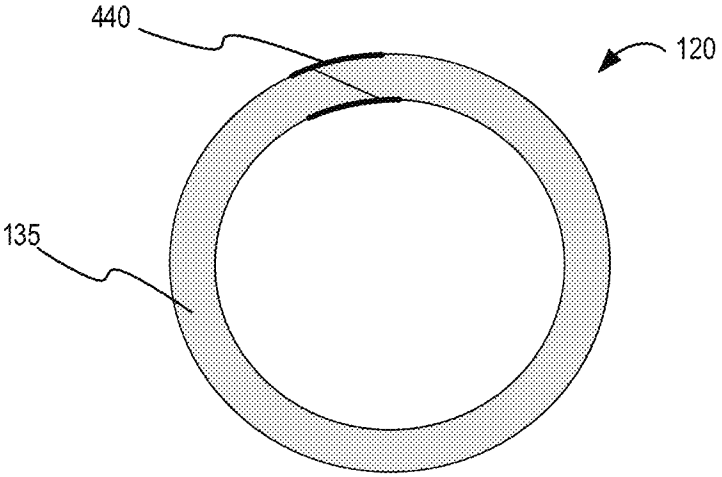
Figure 4C:
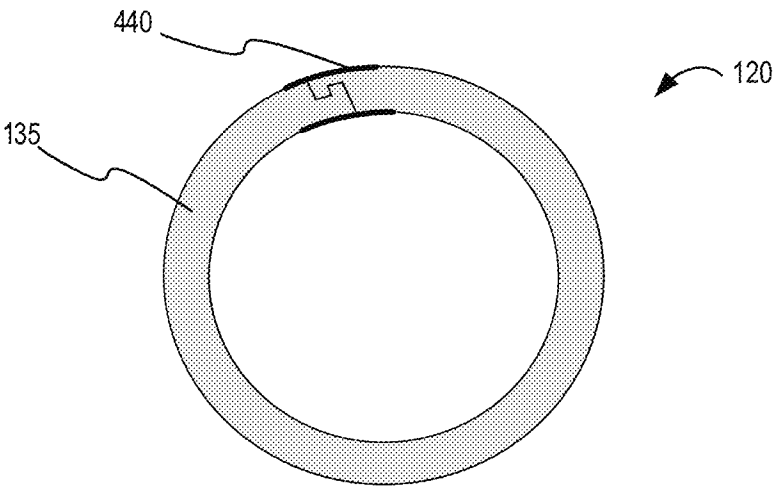
Figure 4D:
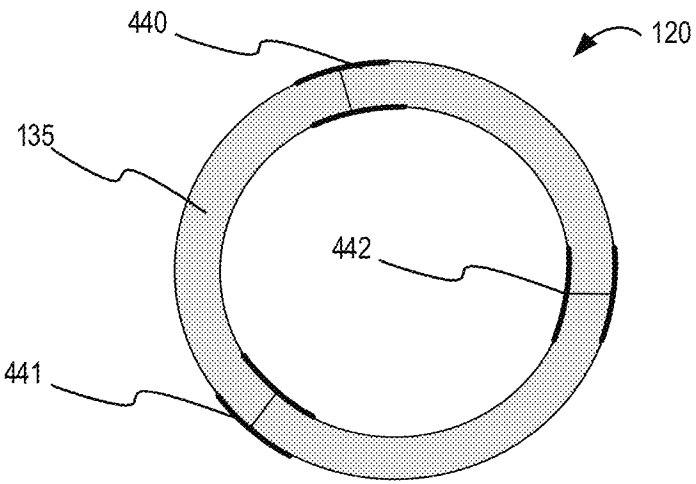

FIGS. 4A-4D depict schematic diagrams of example garter spring assemblies that include an insert having one or more segments, according to some implementations. In some implementations, the insert 135 may be formed from one or more segments of the insert material that are joined together to form the circular ring-shaped insert. FIGS. 4A-4C depict example garter spring assemblies 120 having a single segment. In some implementations, the insert 135 may be cut for installation purposes and then reconnected using a connector 440. For example, the insert 135 may be reconnected using the connector 440 by crimping or other joining technique. The connector may be a brass connector, an aluminum connector, or a steel connector, or other types of connectors. FIG. 4A depicts an example garter spring assembly 120 including the insert 135 having a single straight cut and connector 440. FIG. 4B depicts an example garter spring assembly 120 including the insert 135 having a single diagonal (or scarf) cut and connector 440. FIG. 4C depicts an example garter spring assembly 120 including the insert 135 having a single notch (or joint) cut and connector 440. FIG. 4D depicts an example garter spring assembly 120 including the insert 135 formed from three segments. The insert may include three cuts and three corresponding connectors 440-442. It is noted, however, that the insert 135 may be formed by any number of segments, such as two segments or four or more segments, to form the continuous, circular ring-shaped insert. In some implementations, if the insert 135 is made from a metallic material (e.g., if the insert 135 shown in FIG. 4C is made from a metallic material (such as brass, aluminum, etc.)), the connector 440 may not be added or may be optionally added.

Figure 5:
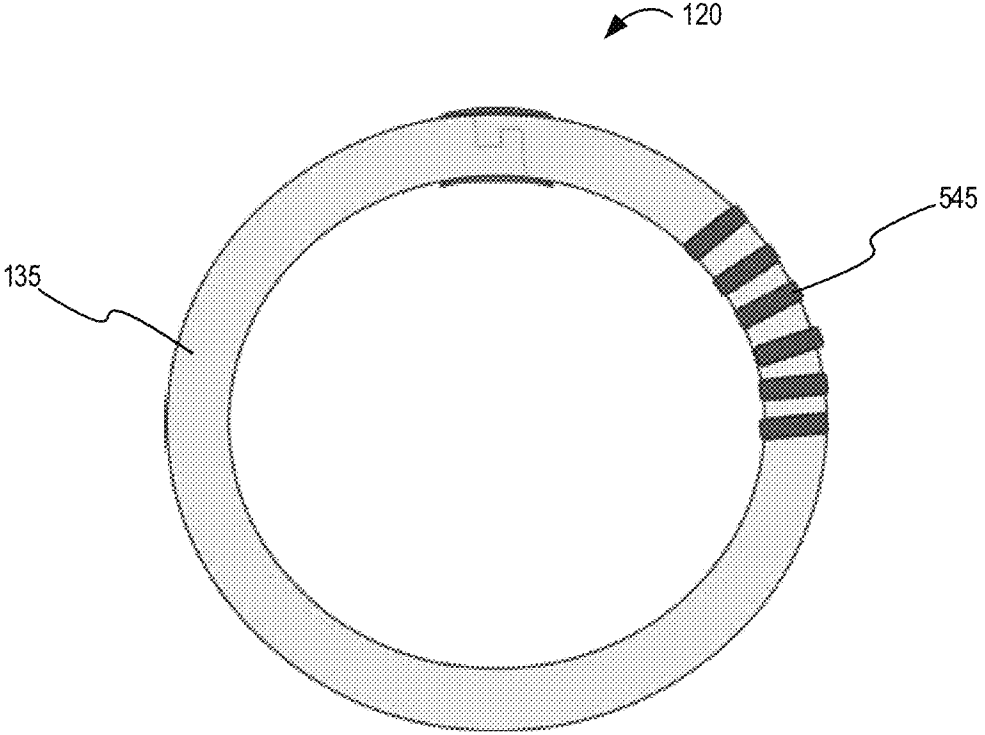
FIG. 5 depicts a schematic diagram of the example garter spring assembly including an insert that is made from a composite material, according to some implementations.

FIG. 5 depicts a schematic diagram of the example garter spring assembly including an insert that is made from a composite material, according to some implementations. In some implementations, the insert 135 of the garter spring assembly 120 can be a composite that includes one or more segments and the one or more segments are hard material segments that are connected by soft material ligaments 545, as shown in FIG. 5. This can adjust the insert's hoop or circular shape stiffness for an easy expansion of the insert 135 along with the garter spring expansion during setting of the sealing device. The hard material segments can be metallic or non-metallic, as described previously. The soft material ligaments 545 may be a rubber material or a polymer material. Example polymer materials may include polyether ether ketone (PEEK) or polytetrafluoroethylene (PTFE), among others.

Figure 6:
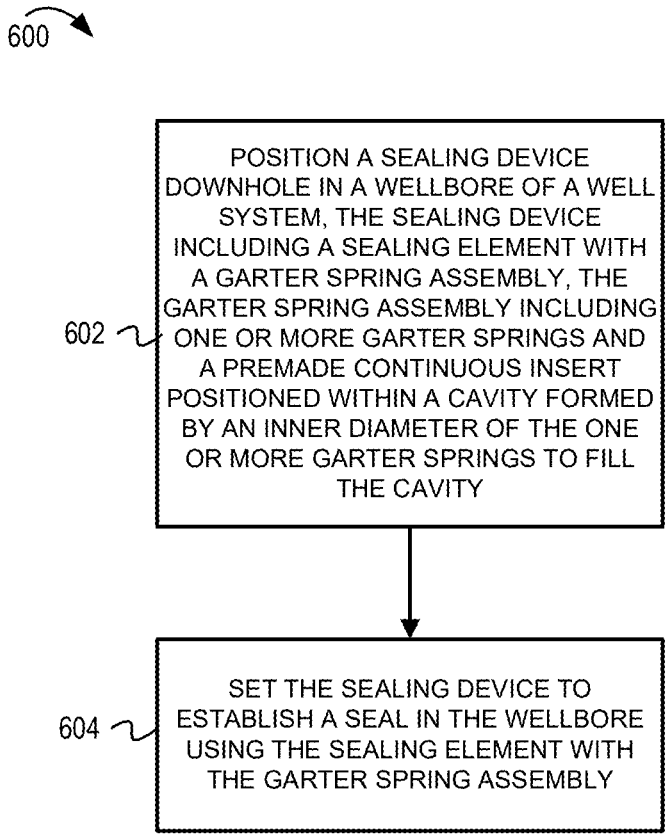
FIG. 6 is a flowchart of example operations for using a sealing device in a well system, according to some implementations.

FIG. 6 is a flowchart 600 of example operations for using a sealing device in a well system, according to some implementations. In some implementations, a sealing device is positioned downhole in a wellbore of a well system. The sealing device may include a sealing element with a garter spring assembly. The garter spring assembly may include one or more garter springs and a premade continuous insert positioned within a cavity formed by an inner diameter of the one or more garter springs to fill the cavity (block 602). In some implementations, the sealing device is set to establish a seal in the wellbore using the sealing element with the garter spring assembly (block 604).

FIG. 7 is a schematic diagram of an example well system that includes fracturing operations, according to some implementations. A well system 700 may comprise a wellbore 704 in a subsurface formation 706. The wellbore 704 may include a casing 702 and a number of perforations 790A-790G being made in the casing 702 at different depths as part of hydraulic fracturing to allow hydraulic communication between the subsurface formation 706 and the casing 702 and to allow fracturing at different zones. The well system 700 may also include sealing devices 795A-795D (e.g., well packers) at the corresponding zones of the wellbore 704. Each of the sealing devices 795A-795D may include a garter spring assembly having one or more garter springs and a premade continuous insert positioned within a cavity of the inner diameter of the one or more garter springs, as described above in FIGS. 1-6. The garter spring assembly may have one or more of the additional features described above in FIGS. 1-6, such as adjacent springs having opposite orientations and the garter spring pitch being greater than the diameter of the garter spring coil.

In some implementations, the well system 700 also may include a fiber optic cable 701. The fiber optic cable 701 may be cemented in place in the annular space between the casing 702 of the wellbore 704 and the subsurface formation 706. In some implementations, the fiber optic cable 701 may be clamped to the outside of the casing 702 during deployment and protected by centralizers and cross coupling clamps. The fiber optic cable 701 may house one or more optical fibers, and the optical fibers may be single mode fibers, multi-mode fibers, or a combination of single mode and multi-mode optical fibers.

In some implementations, the fiber optic cable 701 may be used for distributed sensing where acoustic, strain, and temperature data may be collected. The data may be collected at various positions distributed along the fiber optic cable 701. For example, data may be collected every 1-3 ft along the full length of the fiber optic cable 701. The fiber optic cable 701 may be included with coiled tubing, wireline, loose fiber using coiled tubing, or gravity deployed fiber coils that unwind the fiber as the coils are moved in the wellbore 704. The fiber optic cable 701 also may be deployed with pumped down coils and/or self-propelled containers. Additional deployment options for the fiber optic cable 701 may include coil tubing and wireline deployed coils where the fiber optic cable 701 is anchored at the toe of the wellbore 704. In such embodiments, the fiber optic cable 701 may be deployed when the wireline or coiled tubing is removed from the wellbore 704. The distribution of sensors shown in FIG. 7 is for example purposes only. Any suitable sensor deployment may be used. For example, the well system 700 may include fiber optic cable deployed sensors or sensors cemented into the casing. Different types of sensors deployments also may be combined in a single well, such as including both sensors cemented to the casing and sensors in plugs, flow metering devices, etc. in a single well system.

In some implementations, a fiber optic interrogation unit 712 may be located on the surface 711 of the well system 700. The fiber optic interrogation unit 712 may be directly coupled to the fiber optic cable 701. Alternatively, the fiber optic interrogation unit 712 may be coupled to a fiber stretcher module, wherein the fiber stretcher module is coupled to the fiber optic cable 701. The fiber optic interrogation unit 712 may receive measurement values taken and/or transmitted along the length of the fiber optic cable 701 such as acoustic, temperature, strain, etc. The fiber optic interrogation unit 712 may be electrically connected to a digitizer to convert optically transmitted measurements into digitized measurements. The well system 700 may contain multiple sensors, such as sensors 703A-C. There may be any suitable number of sensors placed at any suitable location in the wellbore 704. The sensors 703A-C may include pressure sensors, distributed fiber optic sensors, point temperature sensors, point acoustic sensors, interferometric sensors or point strain sensors. Distributed fiber optic sensors may be capable of measuring distributed acoustic data, distributed temperature data, and distributed strain data. Any of the sensors 703A-C may be communicatively coupled (not shown) to other components of the well system 700 (e.g., the computer 710). In some implementations, the sensors 703A-C may be cemented to a casing 702.

In some implementations, a computer 710 may receive the electrically transmitted measurements from the fiber optic interrogation unit 712 using a connector 725. The computer 710 may include a signal processor to perform various signal processing operations on signals captured by the fiber optic interrogation unit 712 and/or other components of the well system 700. The computer 710 may have one or more processors and a memory device to analyze the measurements and graphically represent analysis results on the display device 750. The computer system 710 may also control surface equipment and/or one or more downhole tools and devices and/or other well operations.

In some implementations, the fiber optic interrogation unit 712 may operate using various sensing principles including but not limited to amplitude-based sensing systems like Distributed Temperature Sensing (DTS), DAS, Distributed Vibration Sensing (DVS), and Distributed Strain Sensing (DSS). For example, the DTS system may be based on Raman and/or Brillouin scattering. A DAS system may be a phase sensing-based system based on interferometric sensing using homodyne or heterodyne techniques where the system may sense phase or intensity changes due to constructive or destructive interference. The DAS system may also be based on Rayleigh scattering and, in particular, coherent Rayleigh scattering. A DSS system may be a strain sensing system using dynamic strain measurements based on interferometric sensors (e.g., sensors 703A-C) or static strain sensing measurements using Brillouin scattering. DAS systems based on Rayleigh scattering may also be used to detect dynamic strain events. Temperature effects may in some cases be subtracted from both static and/or dynamic strain events, and temperature profiles may be measured using Raman based systems and/or Brillouin based systems capable of differentiating between strain and temperature, and/or any other optical and/or electronic temperature sensors, and/or any other optical and/or electronic temperature sensors, and/or estimated thermal events.

In some implementations, the fiber optic interrogation unit 712 may measure changes in optical fiber properties between two points in the optical fiber at any given point, and these two measurement points move along the optical sensing fiber as light travels along the optical fiber. Changes in optical properties may be induced by strain, vibration, acoustic signals and/or temperature as a result of the fluid flow. Phase and intensity based interferometric sensing systems may be sensitive to temperature and mechanical, as well as acoustically induced, vibrations. The fiber optic interrogation unit 712 may capture DAS data in the time domain. One or more components of the well system 700 may convert the DAS data from the time domain to frequency domain data using Fast Fourier Transforms (FFT) and other transforms. For example, wavelet transforms may also be used to generate different representations of the DAS data. Various frequency ranges may be used for different purposes and where low frequency signal changes may be attributed to formation strain changes or fluid movement and other frequency ranges may be indicative of fluid or gas movement. Various filtering techniques may be applied to generate indicators of events related to measuring the flow of fluid.

In some implementations, DAS measurements along the wellbore 704 may be used as an indication of fluid flow through the casing 702 in the wellbore 704. Vibrations and/or acoustic profiles may be recorded and stacked over time, where a simple approach could correlate total energy or recorded signal strength with known flow rates. For example, the fiber optic interrogation unit 712 may measure energy and/or amplitude in multiple frequency bands where changes in select frequency bands may be associated with oil, water and/or gas thus enabling multiphase production profiling along the wellbore 704.

Although some example well systems are described in FIGS. 1-7, it is noted, however, that the sealing device having a garter spring assembly that includes one or more garter springs and a premade continuous insert or joined-segmented-inserts described in FIGS. 1-7 can be used in any type of well system in the oil and gas industry.

As will be appreciated, aspects of the disclosure may be embodied as a system, method or program code/instructions stored in one or more machine-readable media. Accordingly, aspects may take the form of hardware, software (including firmware, resident software, micro-code, etc.), or a combination of software and hardware aspects that may all generally be referred to herein as a "circuit," "module" or "system." The functionality presented as individual modules/units in the example illustrations can be organized differently in accordance with any one of platform (operating system and/or hardware), application ecosystem, interfaces, programmer preferences, programming language, administrator preferences, etc.

Any combination of one or more machine-readable medium(s) may be utilized. The machine-readable medium may be a machine-readable signal medium or a machine-readable storage medium. A machine-readable storage medium may be, for example, but not limited to, a system, apparatus, or device, that employs any one of or combination of electronic, magnetic, optical, electromagnetic, infrared, or semiconductor technology to store program code. More specific examples (a non-exhaustive list) of the machine-readable storage medium would include the following: a portable computer diskette, a hard disk, a random-access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a machine-readable storage medium may be any tangible medium that can contain, or store a program for use by or in connection with an instruction execution system, apparatus, or device. A machine-readable storage medium is not a machine-readable signal medium.

A machine-readable signal medium may include a propagated data signal with machine-readable program code embodied therein, for example, in baseband or as part of a carrier wave. Such a propagated signal may take any of a variety of forms, including, but not limited to, electromagnetic, optical, or any suitable combination thereof. A machine-readable signal medium may be any machine-readable medium that is not a machine-readable storage medium and that can communicate, propagate, or transport a program for use by or in connection with an instruction execution system, apparatus, or device.

Program code embodied on a machine-readable medium may be transmitted using any appropriate medium, including but not limited to wireless, wireline, optical fiber cable, RF, etc., or any suitable combination of the foregoing.

Computer program code for carrying out operations for aspects of the disclosure may be written in any combination of one or more programming languages, including an object oriented programming language such as the Java® programming language, C++ or the like; a dynamic programming language such as Python; a scripting language such as Perl programming language or PowerShell script language; and conventional procedural programming languages, such as the "C" programming language or similar programming languages. The program code may execute entirely on a stand-alone machine, may execute in a distributed manner across multiple machines, and may execute on one machine while providing results and or accepting input on another machine.

The program code/instructions may also be stored in a machine-readable medium that can direct a machine to function in a particular manner, such that the instructions stored in the machine-readable medium produce an article of manufacture including instructions which implement the function/act specified in the flowchart and/or block diagram block or blocks.

None of the implementations described herein may be performed exclusively in the human mind nor exclusively using pencil and paper. None of the implementations described herein may be performed without computerized components such as those described herein. Some implementations may perform additional operations, fewer operations, operations in parallel or in a different order, and some operations differently.

While the aspects of the disclosure are described with reference to various implementations and exploitations, it will be understood that these aspects are illustrative and that the scope of the claims is not limited to them. In general, techniques for performing NMR measurements and measuring the ringing noise as described herein may be implemented with facilities consistent with any hardware system or hardware systems. Many variations, modifications, additions, and improvements are possible.

Plural instances may be provided for components, operations or structures described herein as a single instance. Finally, boundaries between various components, operations, and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

As used herein, the term "or" is inclusive unless otherwise explicitly noted. Thus, the phrase "at least one of A, B, or C" is satisfied by any element from the set {A, B, C} or any combination thereof, including multiples of any element.

Furthermore, unless otherwise specified, use of the terms "up," "upper," "upward," "uphole," "upstream," or other like terms shall be construed as generally away from the bottom, terminal end of a well; likewise, use of the terms "down," "lower," "downward," "downhole," or other like terms shall be construed as generally toward the bottom, terminal end of the well, regardless of the wellbore orientation. Use of any one or more of the foregoing terms shall not be construed as denoting positions along a perfectly vertical axis. In some instances, a part near the end of the well can be horizontal or even slightly directed upwards. Unless otherwise specified, use of the term "subterranean formation" shall be construed as encompassing both areas below exposed earth and areas below earth covered by water such as ocean or fresh water.

EXAMPLE EMBODIMENTS

Example Embodiments can include the following:

Embodiment #1: A sealing device for a well system, comprising: a sealing element configured to establish a seal in a wellbore of the well system; and a garter spring assembly coupled with the sealing element, the garter spring assembly including: one or more garter springs, and a premade continuous insert positioned within a cavity formed by an inner diameter of the one or more garter springs and configured to fill the cavity.

Embodiment #2: The sealing element of Embodiment #1, wherein the one or more garter springs includes an outer garter spring and an inner garter spring, and the premade continuous insert is configured to fill the cavity formed by the inner diameter of the inner garter spring.

Embodiment #3: The sealing element of Embodiment #1, wherein the premade continuous insert has a circular ring shape and a circular cross-section that is configured to fill the cavity formed by the inner diameter of the one or more garter springs.

Embodiment #4: The sealing element of Embodiment #3, wherein the premade continuous insert is made from one or more insert segments that are joined together to form the circular ring shape.

Embodiment #5: The sealing element of Embodiment #1, wherein the premade continuous insert is made from a nonmetallic or a metallic material.

Embodiment #6: The sealing element of Embodiment #1, wherein the one or more garter springs include two or more garter springs, and adjacent garter springs of the two or more garter springs are positioned to have opposite coil orientations.

Embodiment #7: The sealing element of Embodiment #1, wherein: the one or more garter springs includes a single garter spring, and the premade continuous insert has a diameter that is larger than the inner diameter of the single garter spring; or the one or more garter springs includes an outer garter spring and an inner garter spring, and the premade continuous insert has a diameter that is larger than the inner diameter of the inner garter spring.

Embodiment #8: The sealing element of Embodiment #7, wherein the premade continuous insert is positioned to fill the cavity formed by the inner diameter by a shrink fit technique.

Embodiment #9: The sealing element of Embodiment #1, wherein, for each garter spring of the one or more garter springs, a pitch of the garter spring is larger than a diameter of a coil of the garter spring.

Embodiment #10: A well system, comprising: a well tubing; and one or more sealing devices configured to establish one or more seals in a wellbore of the well system, each sealing device including: a sealing element; and a garter spring assembly coupled with the sealing element, the garter spring assembly including: one or more garter springs, and a premade continuous insert positioned within a cavity formed by an inner diameter of the one or more garter springs and configured to fill the cavity.

Embodiment #11: The well system of Embodiment #10, wherein the one or more garter springs includes an outer garter spring and an inner garter spring, and the premade continuous insert is configured to fill the cavity formed by the inner diameter of the inner garter spring.

Embodiment #12: The well system of Embodiment #11, wherein the premade continuous insert has a circular ring shape and a circular cross-section, and the premade continuous insert is made from one or more insert segments that are joined together to form the circular ring shape.

Embodiment #13: The well system of Embodiment #10, wherein the one or more garter springs include two or more garter springs, and adjacent garter springs of the two or more garter springs are positioned to have opposite coil orientations.

Embodiment #14: The well system of Embodiment #10, wherein: the one or more garter springs includes a single garter spring, and the premade continuous insert has a diameter that is larger than the inner diameter of the single garter spring; or the one or more garter springs includes an outer garter spring and an inner garter spring, and the premade continuous insert has a diameter that is larger than the inner diameter of the inner garter spring.

Embodiment #15: The well system of Embodiment #14, wherein the premade continuous insert is positioned to fill the cavity formed by the inner diameter of the one or more garter springs by a shrink fit technique.

Embodiment #16: The well system of Embodiment #10, wherein, for each garter spring of the one or more garter springs, a pitch of the garter spring is larger than a diameter of a coil of the garter spring.

Embodiment #17: A method for using a sealing device in a well system, comprising: position a sealing device downhole in a wellbore of the well system, the sealing device including a sealing element with a garter spring assembly, the garter spring assembly including one or more garter springs and a premade continuous insert positioned within a cavity formed by an inner diameter of the one or more garter springs to fill the cavity; and setting the sealing device to establish a seal in the wellbore using the sealing element with the garter spring assembly.

Embodiment #18: The method of Embodiment #17, wherein the one or more garter springs includes an outer garter spring and an inner garter spring, and the premade continuous insert is configured to fill the cavity formed by the inner diameter of the inner garter spring.

Embodiment #19: The method of Embodiment #17, wherein the one or more garter springs include two or more garter springs, and adjacent garter springs of the two or more garter springs are positioned to have opposite coil orientations.

Embodiment #20: The method of Embodiment #17, wherein, for each garter spring of the one or more garter springs, a pitch of the garter spring is larger than a diameter of a coil of the garter spring.

What is claimed is:

1. A sealing device for a well system, comprising:

a sealing element configured to establish a seal in a wellbore of the well system; and a garter spring assembly coupled with the sealing element, the garter spring assembly including:

one or more garter springs, wherein, for each garter spring of the one or more garter springs, a pitch of the garter spring is greater than a diameter of a coil of the garter spring, and a premade continuous insert positioned within a cavity formed by an inner diameter of the one or more garter springs and configured to fill the cavity.

2. The sealing element of claim 1, wherein the one or more garter springs includes an outer garter spring and an inner garter spring, and the premade continuous insert is configured to fill the cavity formed by the inner diameter of the inner garter spring.

3. The sealing element of claim 1, wherein the premade continuous insert has a circular ring shape and a circular cross-section that is configured to fill the cavity formed by the inner diameter of the one or more garter springs.

4. The sealing element of claim 3, wherein the premade continuous insert is made from one or more insert segments that are joined together to form the circular ring shape.

5. The sealing element of claim 1, wherein the premade continuous insert is made from a nonmetallic material, aluminum, or brass.

6. The sealing element of claim 1, wherein the one or more garter springs include two or more garter springs, and adjacent garter springs of the two or more garter springs are positioned to have opposite coil orientations.

7. The sealing element of claim 1, wherein:

the one or more garter springs includes a single garter spring, and the premade continuous insert has a diameter that is larger than the inner diameter of the single garter spring; or the one or more garter springs includes an outer garter spring and an inner garter spring, and the premade continuous insert has a diameter that is larger than the inner diameter of the inner garter spring.

8. The sealing element of claim 7, wherein the premade continuous insert is positioned to fill the cavity formed by the inner diameter by a shrink fit technique.

9. A well system, comprising:

a well tubing; and one or more sealing devices configured to establish one or more seals in a wellbore of the well system, each sealing device including:

a sealing element; and a garter spring assembly coupled with the sealing element, the garter spring assembly including:

one or more garter springs, wherein, for each garter spring of the one or more garter springs, a pitch of the garter spring is greater than a diameter of a coil of the garter spring, and a premade continuous insert positioned within a cavity formed by an inner diameter of the one or more garter springs and configured to fill the cavity.

10. The well system of claim 9, wherein the one or more garter springs includes an outer garter spring and an inner garter spring, and the premade continuous insert is configured to fill the cavity formed by the inner diameter of the inner garter spring.

11. The well system of claim 10, wherein the premade continuous insert has a circular ring shape and a circular cross-section, and the premade continuous insert is made from one or more insert segments that are joined together to form the circular ring shape.

12. The well system of claim 9, wherein the one or more garter springs include two or more garter springs, and adjacent garter springs of the two or more garter springs are positioned to have opposite coil orientations.

13. The well system of claim 9, wherein:

the one or more garter springs includes a single garter spring, and the premade continuous insert has a diameter that is larger than the inner diameter of the single garter spring; or the one or more garter springs includes an outer garter spring and an inner garter spring, and the premade continuous insert has a diameter that is larger than the inner diameter of the inner garter spring.

14. The well system of claim 13, wherein the premade continuous insert is positioned to fill the cavity formed by the inner diameter of the one or more garter springs by a shrink fit technique.

15. A method for using a sealing device in a well system, comprising:

positioning a sealing device downhole in a wellbore of the well system, the sealing device including a sealing element with a garter spring assembly, the garter spring assembly including one or more garter springs, wherein, for each garter spring of the one or more garter springs, a pitch of the garter spring is greater than a diameter of a coil of the garter spring, and the garter spring assembly further including a premade continuous insert positioned within a cavity formed by an inner diameter of the one or more garter springs to fill the cavity; and setting the sealing device to establish a seal in the wellbore using the sealing element with the garter spring assembly.

16. The method of claim 15, wherein the one or more garter springs includes an outer garter spring and an inner garter spring, and the premade continuous insert is configured to fill the cavity formed by the inner diameter of the inner garter spring.

17. The method of claim 15, wherein the one or more garter springs include two or more garter springs, and adjacent garter springs of the two or more garter springs are positioned to have opposite coil orientations.

* * * * *